US006788321B2

(12) United States Patent
Araki et al.

(10) Patent No.: US 6,788,321 B2
(45) Date of Patent: Sep. 7, 2004

(54) IMAGE FORMING APPARATUS INCLUDING HOLDING MEMBER

(75) Inventors: Tomoyuki Araki, Shizuoka (JP); Tamotsu Kaneko, Shizuoka (JP); Hideyuki Miyamoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/368,620

(22) Filed: Feb. 20, 2003

(65) Prior Publication Data

US 2003/0160856 A1 Aug. 28, 2003

(30) Foreign Application Priority Data

Feb. 22, 2002 (JP) ..... 2002-046705

(51) Int. Cl.[7] ..... G03G 15/00
(52) U.S. Cl. ..... 347/138; 399/110; 399/118
(58) Field of Search ..... 347/138, 152, 347/242, 245, 257, 263; 399/110, 111, 118, 112

(56) References Cited

U.S. PATENT DOCUMENTS 4,479,061 A 10/1984 Koizumi et al.
6,534,761 B2 3/2003 Fukatsu et al.

FOREIGN PATENT DOCUMENTS

JP 11-219006 A * 8/1999
JP 2001-154438 6/2001

* cited by examiner

*Primary Examiner*—Susan Lee
(74) *Attorney, Agent, or Firm*—Fitzpatrick, Cella, Harper & Scinto

(57) ABSTRACT

An image forming apparatus is provided with a scanning unit emitting a laser beam, and an openable and closable member openable and closable relative to an image forming apparatus main body, and the openable and closable member has a positioning portion for positioning the scanning unit. Thereby, the scanning unit can be accurately positioned in the image forming apparatus main body.

15 Claims, 7 Drawing Sheets

PRIOR ART

PRIOR ART

IMAGE FORMING APPARATUS INCLUDING HOLDING MEMBER

BACKGROUND OF THE INVENTION

1. Field of the Invention

This invention relates to an image forming apparatus such as a printer or a copying machine, and particularly to an image forming apparatus provided with a scanning unit emitting a laser beam.

2. Description of Related Art

FIG. 4 of the accompanying drawings shows an image forming apparatus according to the prior art. In a housing 101, there is contained an optical scanning device 102. The optical scanning device 102 is contained in the housing 101 while an openable and closable member 104 which is a portion of the housing 101 remains opened, and is positioned and fixed at a predetermined position.

That is, the openable and closable member 104 located on the upper surface of the housing 101 is opened, and the optical scanning device 102 is inserted from above. The optical scanning device 102, as shown in FIG. 5 of the accompanying drawings, is installed at a predetermined position in the housing 101 relative to a photosensitive drum 103. The optical scanning device 102 is fixed at four locations by screws 105 in a state in which the openable and closable member of the housing 101 is opened, and the work of fixing the optical scanning device 102 is terminated.

After the work of fixating the optical scanning device 102 has been terminated, an opening portion 101A is closed by the openable and closable member 104 in the upper portion, and the housing 101 is completed so as to surround the optical scanning device 102 in the housing 101 in the shape of a box. Thereby, the housing has housing strength which can withstand a load during the operation, the insertion shock of a cartridge (CRG) and a shock during shipment.

However, in an image forming apparatus provided with the photosensitive drum 103 and the optical scanning device 102, it is necessary to dispose the locations of both of them accurately in the interior of the housing 101. Moreover, the optical scanning device 102 must be housed and disposed in the interior of the housing 101 and therefore, the opening portion 101A to a housing portion in the housing 101 must be provided without fail. Consequently, when the opening portion 101A is provided and the optical scanning device 102 is to be housed in the housing 101, a portion of the housing 101 is opened in the opening portion 101A and therefore, the strength of the housing 101 is more reduced than in a state in which the opening portion 101A is closed by the openable and closable member 104.

Accordingly, even if the optical scanning device 102 is housed accurately relative to the photosensitive drum 3 with the openable and closable member 104 being opened, the strength of the housing 101 is reduced and therefore, during the time until the opening portion 101A is closed by the openable and closable member 104 and the strength of the housing 101 is completed, distortion occurs to the housing 101 and after all, there has been the possibility that disorder occurs to the positions of the photosensitive drum 103 and the optical scanning device 102.

Particularly, in the case of an image forming apparatus housing a plurality of optical scanning devices 102 therein, the rate of a housing portion housing the optical scanning devices 102 occupied in the housing 101 becomes great and moreover, the opening portion 101A for inserting the optical scanning devices 102 therethrough into the housing portion also becomes large and therefore, the possibility that disorder occurs to the positions of the photosensitive drum 103 and the optical scanning devices 102 before the strength of the housing 102 is completed has become high.

Also, to obtain the strength of the housing with the openable and closable member 104 opened, it is necessary to increase the skeletal parts of the housing for reinforcement or to make the skeletal parts of the housing high in strength, and this has compelled a considerable increase in cost.

Further, when in the market, some trouble occurs to the optical scanning devices 102 and the interchange thereof becomes unavoidable, it is also necessary to open the opening portion 101A of the housing 101. If at such time, the loading portion of the housing 101 is opened in a place where, unlike a production site, there is no jig for accurately supporting the housing, distortion may occur to the housing 101 depending on the unevenness of a floor on which the image forming apparatus is installed. Accordingly, when the positions of the optical scanning devices 102 are determined with the opening portion opened, there has been a case where after all, disorder occurs to the positional relation between the photosensitive drum 103 and the optical scanning device 102 after the openable and closable member is closed. As described above, there has been a case where not only the relative position of the optical scanning device to the photosensitive drum, but also when there are a plurality of optical scanning devices, the relative position between the optical scanning devices is not ensured.

SUMMARY OF THE INVENTION

It is an object of the present invention to provide an image forming apparatus which enables a scanning unit to be accurately positioned in the main body thereof.

It is another object of the present invention to provide an image forming apparatus having a scanning unit emitting a laser beam, and an openable and closable member openable and closable relative to an image forming apparatus main body, the openable and closable member having a positioning portion for positioning the scanning unit.

Further, objects of the present invention will become apparent from the following description.

DESCRIPTION OF THE PREFERRED EMBODIMENTS

An embodiment of the present invention will hereinafter be described in detail with reference to the drawings.

Figure 1:
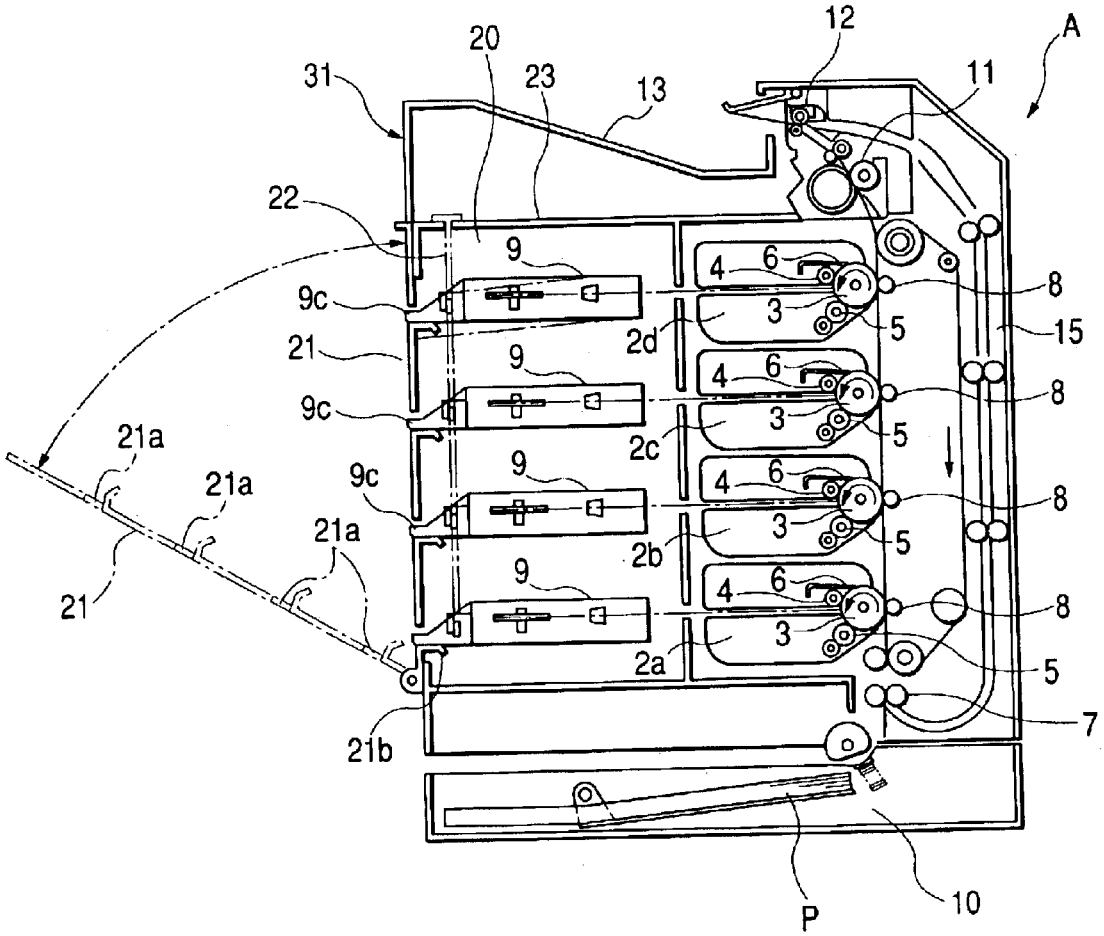
FIG. 1 is a main cross-sectional view of an image forming apparatus according to an embodiment of the present invention.

FIG. 1 shows an image forming apparatus according to an embodiment of the present invention.

The basic construction of the whole of the image forming apparatus will first be described.

The image forming apparatus A has four detachably mountable image forming process cartridges 2*a*, 2*b*, 2*c* and 2*d* correspondingly to four different toner colors, e.g. cyan, magenta, yellow and black. In each of these process cartridges 2*a* to 2*d*, there is provided an electrophotographic photosensitive drum 3 which is an image bearing member, charging means 4 for charging the surface of the photosensitive drum, developing means 5 for developing a latent image on the photosensitive drum by a toner, and cleaning means 6 for removing any residual toner after transfer. In the image forming apparatus A, a sheet material P which is a recording material separated and fed from a recording material cassette (paper cassette) 10 is transported to an image forming portion comprising the process cartridges 2*a* to 2*d*, transfer rollers 8 which are transferring means, etc. at predetermined timing by a registration roller unit 7, and a desired image is printed on the upper surface of the sheet material P.

Figure 3:
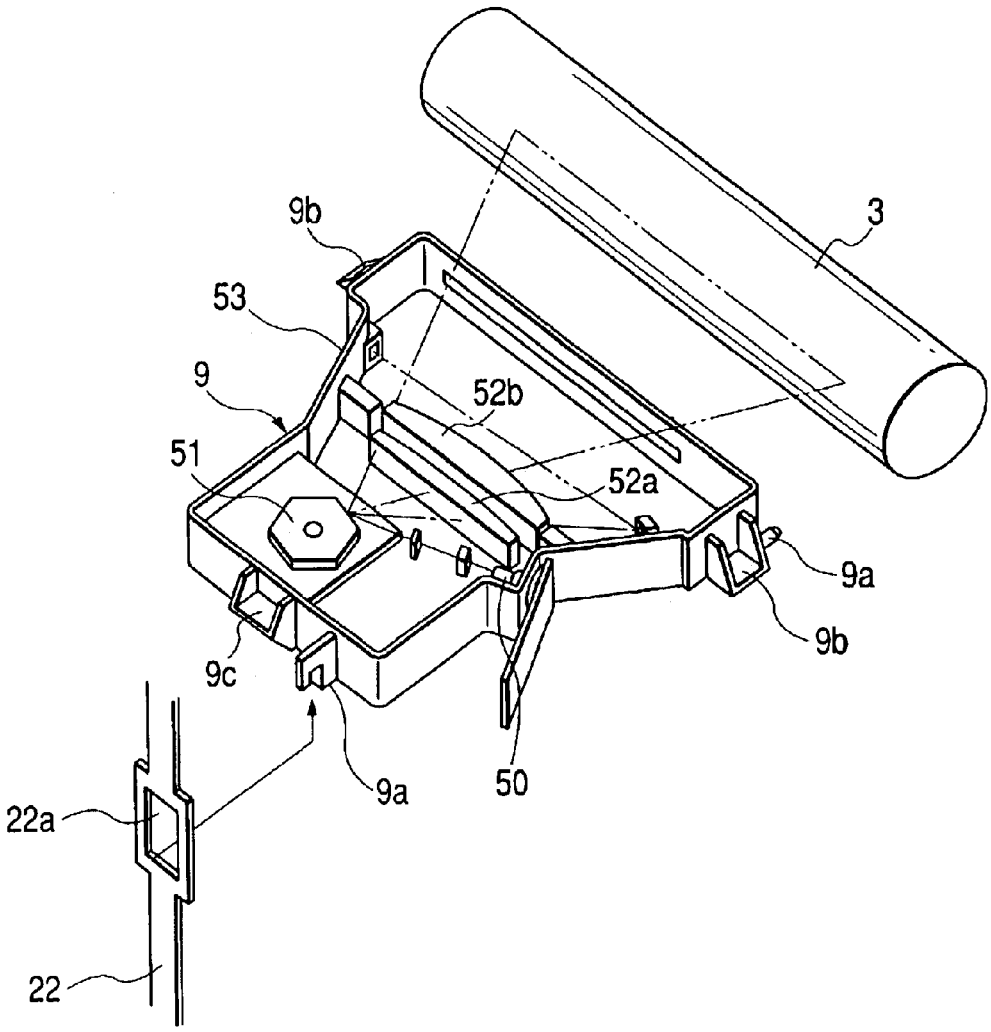
FIG. 3 shows the relation between the hook portion of the scanner unit of the image forming apparatus of FIG. 1 and the opening portion of a tentatively holding member.
Figure 4:
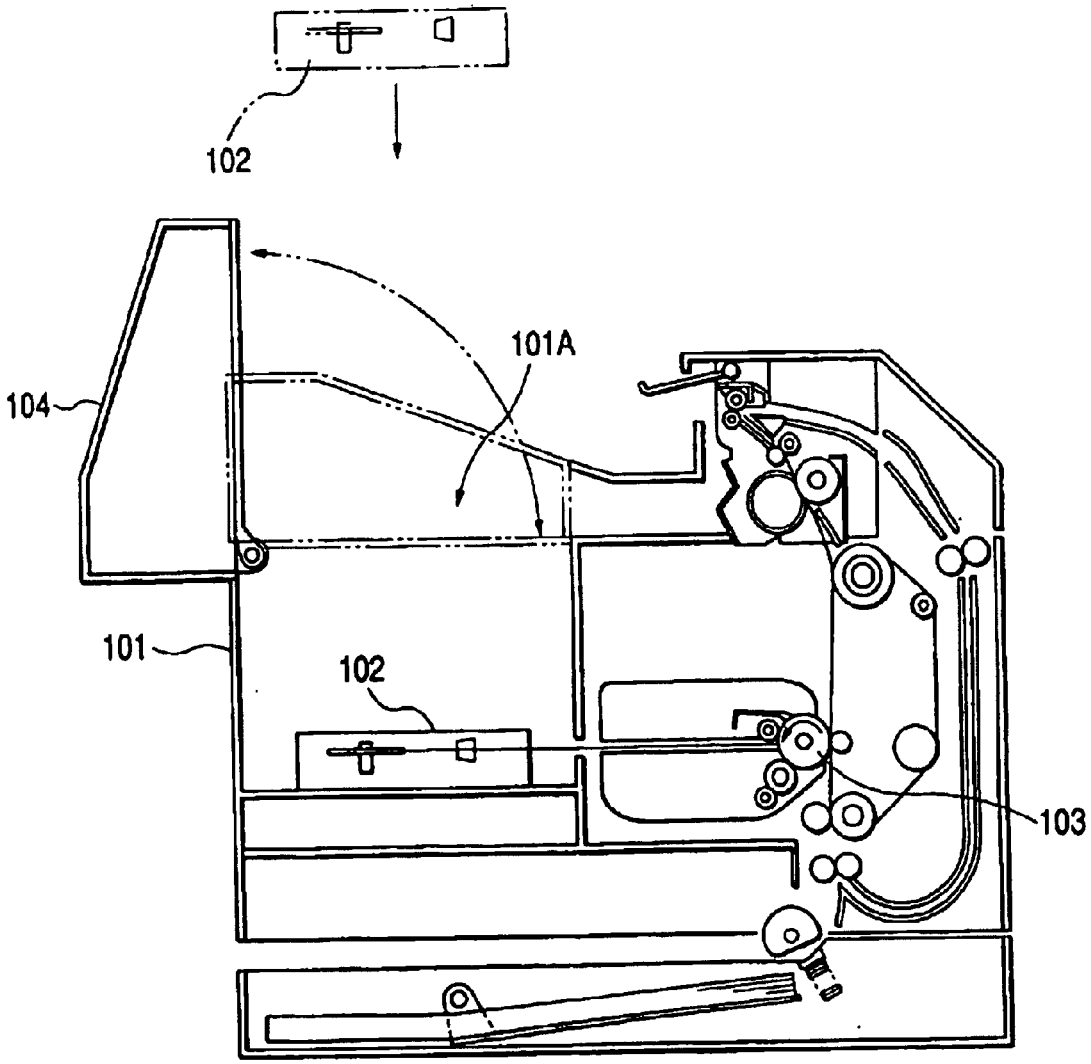
FIG. 4 is a main cross-sectional view of an image forming apparatus according to the prior art.
Figure 5:
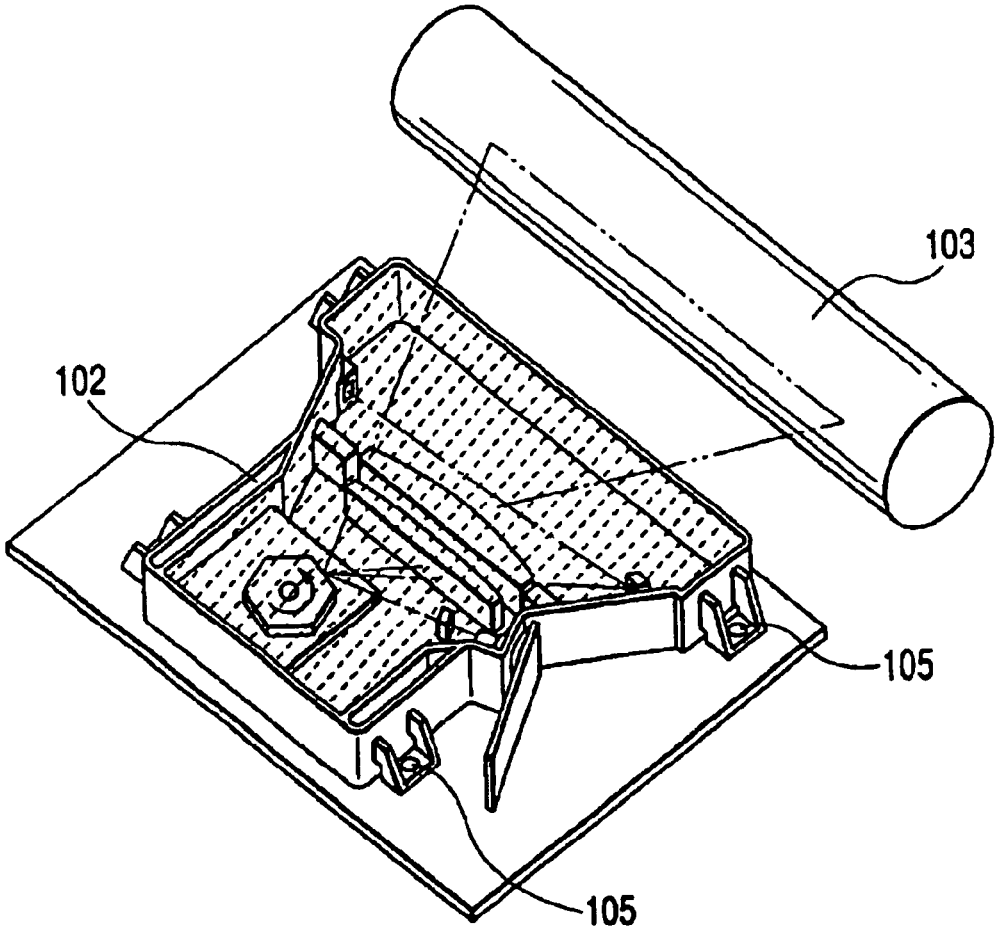
FIG. 5 is an illustration of the positioned and fixed state of an optical scanning device in FIG. 4.

The reference numeral 9 designates scanning units emitting a laser beam, and as shown in FIG. 3, each scanning unit has a light source 50, deflecting means 51 for deflecting a laser beam emitted from the light source 50, lenses 52*a* and 52*b* through which the laser beam deflected by the deflecting means 51 is transmitted, and a box 53 containing therein the light source 50, the deflecting means 51 and the lenses 52*a*, 52*b*.

A plurality of scanning units 9 are provided correspondingly to the respective colors of the process cartridges, and in the present embodiment, four scanning units 9 are provided.

A laser beam is applied from the scanning unit 9 which is an optical scanning device to the photosensitive drum 3 charged by the charging means 4, and a latent image is formed on the photosensitive drum 3. This latent image is developed with a toner by the developing means 5, and this toner image is transferred to the sheet material P borne on and transported by a belt 40, by the transfer roller 8. The transfer roller 8 urges the sheet material P fed from the recording material cassette 10 against the photosensitive drum 3 with the belt 40 interposed therebetween, and a voltage opposite in polarity to the charged toner image is applied to the transfer roller 8, whereby the toner image is transferred to the sheet material. When this process is sequentially carried out from upstream toward downstream with respect to the transport direction of the sheet material by the process cartridges 2*a* to 2*d* and the transfer of the images of four colors is terminated, images of four colors laminated are formed on the surface of the sheet material. The belt 40 bears the sheet material thereon and is moved in the direction of arrow.

Downstream of the image forming portion, there is provided fixing means 11 for fixing the toner images transferred onto the sheet material P on the sheet material P.

The sheet material P to which the transfer of the image has been completed passes the fixing means 11 having a heating member, whereby the laminated toner images of four colors are fixed on the sheet material P, and a full-color image is formed on the sheet material. The sheet material on which the image has been fixed is delivered out of the image forming apparatus by delivery rollers 12, and is stacked on a stacking tray B disposed below the delivery rollers 12.

Figure 2:
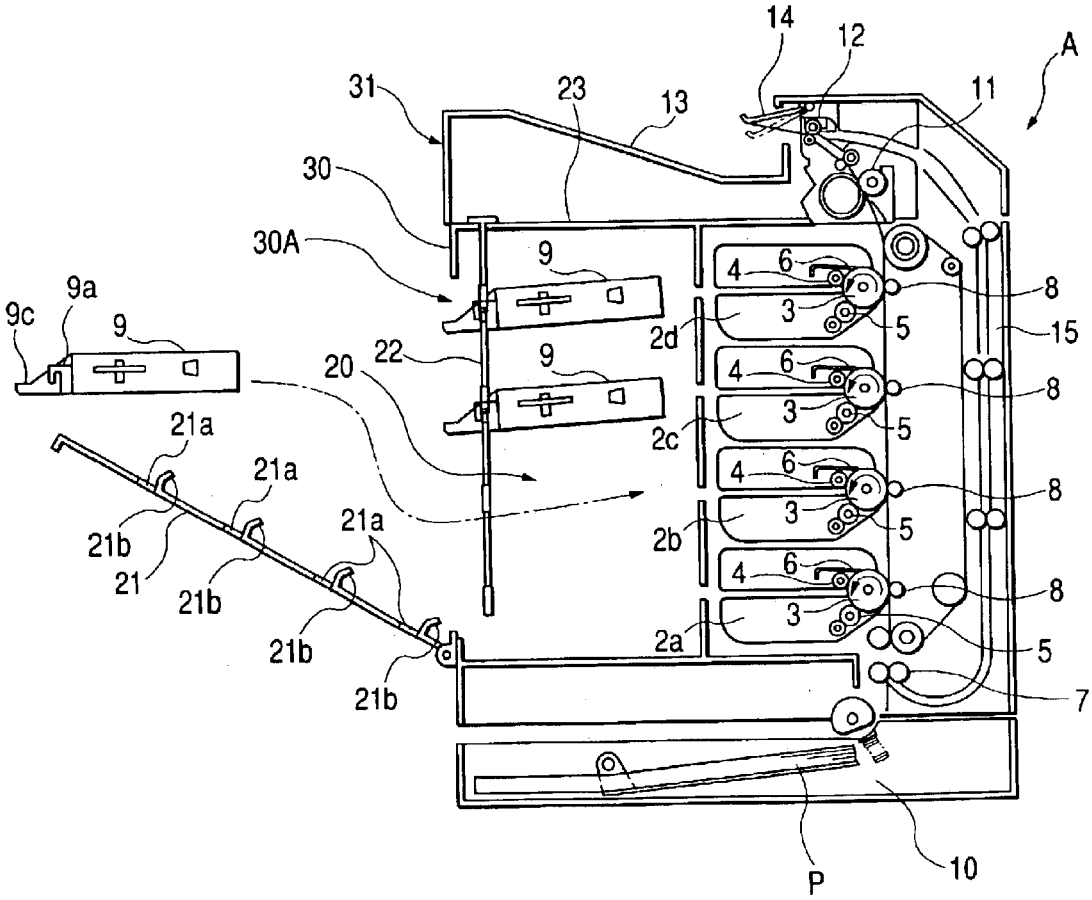
FIG. 2 is an illustration of the tentatively held state of the scanner unit of the image forming apparatus of FIG. 1.

The reference numeral 21 denotes an openable and closable member openable and closable to an image forming apparatus main body 31, and specifically the openable and closable member 21 forms a portion of a housing. That is, the housing 30 on the apparatus main body side has an insertion opening portion 30A for putting the scanning unit 9 in and out therethrough, and the openable and closable member 21 opens and closes this opening portion 30A. When as shown in FIG. 2, the scanning unit 9 is to be housed in a housing 30, the openable and closable member 21 provided on the side portion of the housing 30 is opened and the scanning unit 9 is inserted through the opening portion 30A.

A holding member 22 for temporarily tentatively holding the scanning unit 9 during the work of housing the scanning unit 9 is provided in a housing portion 20 in the housing 30.

A plurality of scanning units 9 are housed in parallel in the housing 30, and the opening portion 30A is disposed on a side opposite to the photosensitive drum 3 which is the image forming portion side with respect to the scanning units 9, and the holding member 22 for tentatively holding the scanning units 9 is also disposed on the same side as the opening portion 30A which is a side opposite to the photosensitive drum 3.

In the shown example, the plurality of scanning units 9 are vertically provided in parallel in the housing 30, and the opening portion of the scanning unit 9 and the holding member 22 are disposed on a side opposite to the photosensitive drum 3, and the holding member 22 is of a deformable construction and is substantially vertically suspended from above the housing portion 20.

The tentative holding position by the holding member 22 is designed such that at least a portion of the scanning units is below a regular position in which the scanning units are originally held during image formation.

The openable and closable member 21 is provided with a positioning portion 21*a* for contacting with a portion of the scanning units 9 and holding the scanning units 9 at the regular position during image formation when the opening portion 30A is closed, and effecting the positioning of the scanning units.

As shown in FIG. 3, the positioning and fixation of the scanning unit 9 in the housing 30 is done at positioning and fixating portion 9*b* on a side near to the photosensitive drum 3 and a positioning and fixating portion 9*c* on a side opposite to the photosensitive drum 3, and the positioning and fixating portion 9*c* is engaged with the positioning portion 21*a* of the openable and closable member 21, whereby the position of the scanning unit is determined. Also, at least two, in the shown example, a pair of right and left positioning and fixating, portions 9*b* are provided on the side near to the photosensitive drum 3. The positioning and fixating portions 9*b* and 9*c* are contact portions contacting with an apparatus main body side positioning portion and the positioning portion of the openable and closable member.

The positioning portion 21*a* of the openable and closable member 21 is constituted by an engagement hole (an opening portion) engaged by the protruding piece of the positioning and fixating portion 9*c* protruding from a side of the box 53 of the scanning unit 9. The lower edge of the hole is provided with a slope 21*b* for receiving the positioning and fixating portion 9*c*.

Figure 6:
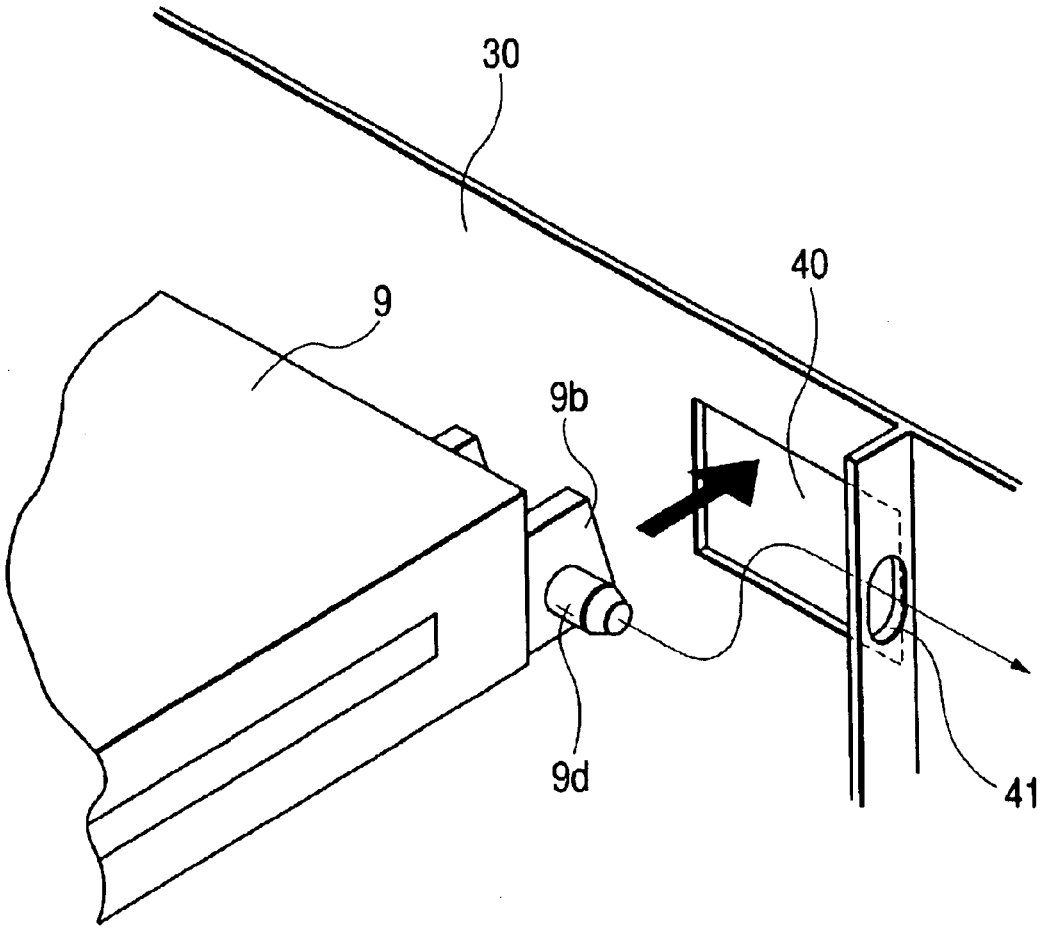
FIG. 6 is an illustration of a method of positioning and holding a scanning unit on a side near to the photosensitive drum of the image forming apparatus of FIG. 1.
Figure 7:
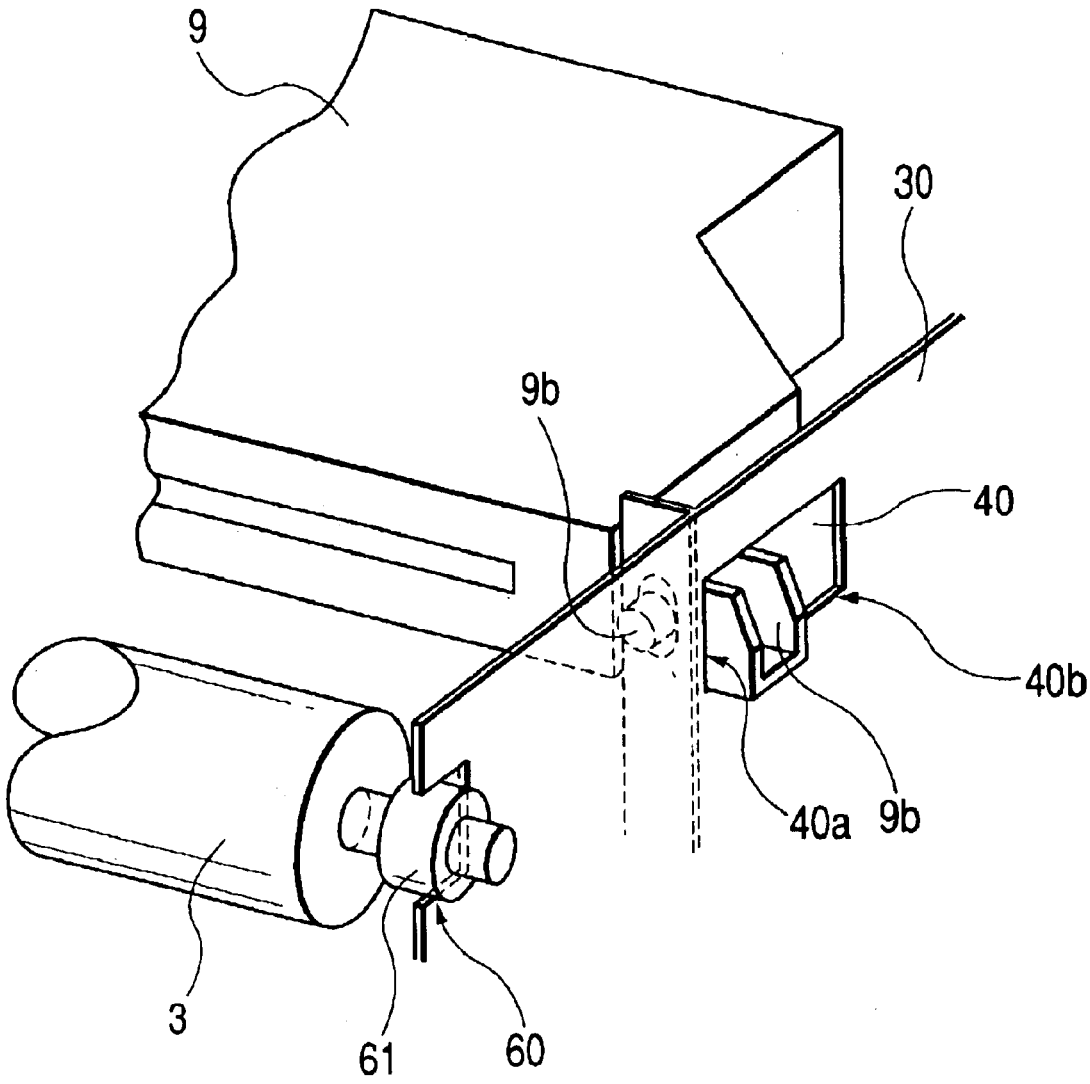
FIG. 7 is an illustration of a method of positioning and holding the scanning unit on a side near the photosensitive drum of the image forming apparatus of FIG. 1.

FIGS. 6 and 7 are views for illustrating a method of positioning and holding the scanning unit 9 on the side near to the photosensitive drum.

As shown, the positioning and fixating portion 9*b* of the scanning unit 9 is inserted into an opening portion 40 which is a positioning portion provided in the housing 30, and the vertical surface of the positioning and fixating portion 9*b* which is adjacent to the photosensitive drum is rammed against the vertical edge 40*a* of the opening portion 40 to thereby determine the horizontal position (a direction orthogonal to the axial direction of the photosensitive drum) of the scanning unit 9. Then, the bottom surface of the positioning and fixating portion 9*b* is placed on the horizontal edge 40*b* of the opening portion 40, whereby the vertical position of the scanning unit 9 on the side near to the photosensitive drum is determined.

Further, regarding the positioning of the scanning unit 9 relative to the axial direction of the photosensitive drum, a boss 9*d* provided on the scanning unit 9 is brought into engagement with the vertically long hole 41 of the housing 30 simultaneously with the above-described inserting work, whereby the horizontal position (the axial direction of the photosensitive drum) can be ensured.

As shown in FIG. 7, design is made such that the photosensitive drum 3 also has its position determined by a bearing portion 61 being placed on the edge 60 of an opening portion also provided in the housing 30.

Each of the scanning unit 9 and the photosensitive drum 3 is positioned in a part of the housing 30 and therefore, their relative positional relationship can be ensured.

In the housing portion 20, the holding member 22 is suspended from the ceiling portion 23 of the housing near the opening portion 30A on the side opposite to the photosensitive drum 3, and when the scanning unit 9 is to be inserted into the housing 30, the positioning and fixating portions 9*b* on the side near to the photosensitive drum 3 are inserted into the positioning portion 40 provided on the housing 30 side and at the same time, a hook portion 9*a* which is a hanging portion provided on the scanning unit 9 is sequentially hung on an opening portion 22*a* provided in the holding member 22 to thereby effect the tentative holding of the scanning unit 9. The holding member 22 is provided with four opening portions 22*a*, and the tentative holding of four scanning units is possible by a holding member.

As the opening portion 30A is closed by the openable and closable member 21 after the tentative holding of the scanning unit 9 has been terminated, the positioning and fixating portion 9*c* of the scanning unit 9 is scooped up by the slope 21*b* provided on the positioning portion 21*a* of the openable and closable member 21, and the hook portion 9*a* is disengaged from the edge of the opening portion 22*a* of the holding member 22, and the positioning and fixating portion 9*c* is guided to the positioning portion 21*a* of the openable and closable member 21. As soon as the opening portion 30A is closed by the openable and closable member 21 and the strength of the housing 30 is completed, the position of each scanning unit 9 in the housing 30 is determined.

In this manner, the insertion of the scanning units 9 into the housing 30 is completed to thereby bring about a state indicated by solid line in FIG. 1.

That is, design is made such that by the opening portion 30A being closed by the openable and closable member 21, the scanning units 9 are displaced from a tentatively stopped position to a regular position, and that by the openable and closable member 21 being closed, the image forming apparatus assumes "a closed box shape" constituted by at least six (upper, lower, right, left, front and rear) walls.

Accordingly, simply by the openable and closable member 21 being closed, the scanning units 9 can be automatically positioned at regular positions and at this time, the scanning units 9 have their positions relative to the photosensitive drums 3 ensured and are housed in the housing portion 20 in the housing 30.

The holding member 22 for tentatively holding the scanning units 9 remains in the housing portion 20 of the housing, and when the scanning units 9 are to be interchanged again, the detachment of the openable and closable member 21 of the opening portion 30A is effected, whereupon at least a part of the scanning units 9 is displaced downwardly from the regular position by the gravity thereof and the scanning units 9 are again tentatively stopped by the holding member 22.

That is, when the scanning units 9 go wrong and it becomes necessary to interchange them in the market, the openable and closable member 21 will be opened again and the scanning units will be interchanged with normal scanning units 9, but if the present invention is applied to the image forming apparatus, when the openable and closable member 21 is opened, the scanning units 9 will be downwardly inclined by gravity and the hook portions 9*a* of the scanning units will be caught again by the opening portion 22*a* of the holding member 22, and the scanning units will become tentatively held as shown in FIG. 2.

The openable and closable member 21 is then returned to its original position after the termination of the interchanging work, whereby by way of the same process as that previously described, the positions of the scanning units 9 is again directed to the regular positions without any problem.

As described above, according to the present invention, even if the opening portion 30A for inserting the scanning units therethrough becomes large, the scanning units are tentatively held by the holding member during the interchanging work during which the opening portion is opened, and in a state in which the opening portion is closed and the strength as the housing has become sufficient, the positioning of the scanning units is done and therefore, it is not necessary to enhance the strength of the housing in its opened state.

Therefore, it is not necessary to increase the skeletal parts of the housing or to use a material of high strength for the parts of the housing and thus, an increase in cost is avoided and moreover, the weight of the image forming apparatus is neither increased and therefore, the installing work becomes easy and moreover, this is also effective in the sense of the limitation of the strength of a desk which provides an installation bed, and also leads to the mitigation of shipping costs.

Also, it is unnecessary to determine the positions of the scanning units while a portion of the housing is left open, and as soon as the inclusion of the scanning units into the housing portion of the housing is completed and the strength of the housing portion of the housing is secured, the final positions of the scanning units are determined and therefore, it becomes possible to make a construction in which during the assembly of the image forming apparatus, it is difficult for the housing to be affected by disturbance which may cause the housing to be distorted.

Further, when the scanning units are to be interchanged in the market, even if a portion of the housing is opened, the scanning units are received onto the holding member by gravity and therefore, during the interchanging work in the market, the interchange of the scanning unit can be accurately effected with respect to the image forming apparatus main body without such a large-scale jig as is used in a factory.

While an embodiment of the present invention has been described above, the present invention is not restricted to the above-described embodiment, but all modifications are possible within the technical idea of the present invention.

What is claimed is:

1. An image forming apparatus comprising:

a scanning unit for emitting a laser beam; and an openable and closable member for opening and closing relative to a main body of the image forming apparatus, said openable and closable member including a positioning portion for positioning said scanning unit; and a holding member for temporarily holding said scanning unit when said openable and closable member is opened.

2. An image forming apparatus according to claim 1, wherein said scanning unit disengages from a holding portion of said holding member and is supported by the positioning portion of said openable and closable member when the openable and closable member is closed.

3. An image forming apparatus according to claim 1, wherein said scanning unit is provided in a plurality, and the said holding member has a plurality of holding portions.

4. An image forming apparatus according to claim 3, wherein said plurality of scanning units are arranged substantially in a vertical direction.

5. An image forming apparatus according to claim 4, wherein the positioning portion of said openable and closable member is located above the holding portions of said holding member.

6. An image forming apparatus according to claim 1, wherein said scanning unit has a contact portion for coming in contact with the positioning portion of said openable and closable member.

7. An image forming apparatus according to claim 1, further comprising:

a photosensitive member to which the laser beam emitted from said scanning unit is applied, irradiated, wherein the main body of the image forming apparatus has another positioning portion for positioning the said scanning unit on a side more adjacent to said photosensitive member than to said openable and closable member.

8. An image forming apparatus according to claim 7, wherein said scanning unit has another contact portion for coming in contact with the another positioning portion of the main body of the image forming apparatus.

9. An image forming apparatus according to claim 1, wherein said scanning unit is mountable on or detachable from the main body of the image forming apparatus when said openable and closable member is opened.

10. An image forming apparatus according to claim 1, wherein said scanning unit has a light source, deflecting means for deflecting a laser beam emitted from said light source, a lens through which the laser beam deflected by said deflecting means is transmitted, and a box containing therein said light source, said deflecting means, and said lens.

11. An image forming apparatus comprising:

a scanning unit for emitting a laser beam;

an openable and closable member for opening and closing relative to a main body of the image forming apparatus; and a holding member for temporarily holding said scanning unit when said openable and closable member is opened, wherein said scanning unit disengages from a holding portion of said holding member and is positioned when said openable and closable member is closed.

12. An image forming apparatus according to claim 11, wherein said scanning unit is provided in a plurality, and said holding member has a plurality of holding portions.

13. An image forming apparatus according to claim 12, wherein said plurality of scanning units are arranged substantially in a vertical direction.

14. An image forming apparatus according to claim 11, wherein said scanning unit is mountable on or detachable from the main body of the image forming apparatus when said openable and closable member is opened.

15. An image forming apparatus according to claim 11, wherein said scanning unit has a light source, deflecting means for deflecting a laser beam emitted from said light source, a lens through which the laser beam deflected by said deflecting means is transmitted, and a box containing therein said light source, said deflecting means and said lens.

* * * * *

UNITED STATES PATENT AND TRADEMARK OFFICE

CERTIFICATE OF CORRECTION

PATENT NO. : 6,788,321 B2
DATED : September 7, 2004
INVENTOR(S) : Tomoyuki Araki et al.

It is certified that error appears in the above-identified patent and that said Letters Patent is hereby corrected as shown below:

Column 7,
Line 5, "and" should be deleted.
Lines 19 and 38, "the" should be deleted.
Line 35, "applied," should be deleted.

Signed and Sealed this

Fifth Day of April, 2005

JON W. DUDAS
*Director of the United States Patent and Trademark Office*